United States Patent [19]

Barlow

[11] 4,348,028

[45] Sep. 7, 1982

[54] BOARD GAME WITH RANDOM WATER DISTRIBUTION FOR DUNKING PLAYING PIECES

[75] Inventor: Gordon A. Barlow, Glenview, Ill.

[73] Assignee: Gordon Barlow Design, Skokie, Ill.

[21] Appl. No.: 233,160

[22] Filed: Feb. 10, 1981

[51] Int. Cl.[3] ..... A63F 3/00; A63H 33/00

[52] U.S. Cl. ..... 273/249; 273/287; 46/41; 46/43

[58] Field of Search ..... 273/249, 287, 281; 46/41, 43

[56] References Cited

U.S. PATENT DOCUMENTS

| | | | |
|---|---|---|---|
| 3,298,692 | 1/1967 | Glass et al. | 273/243 |
| 3,649,021 | 3/1972 | Hayes | 273/287 X |
| 4,219,198 | 8/1980 | Meyer et al. | 273/399 |

OTHER PUBLICATIONS

Multiple Products Catalog, 1965, p. 124.

*Primary Examiner*—Richard C. Pinkham
*Assistant Examiner*—Scott L. Brown
*Attorney, Agent, or Firm*—Kinzer, Plyer, Dorn & McEachran

[57] ABSTRACT

A board game including a base having a path on which playing pieces can be moved from a starting point to a finish point. A number of dunking stations for the playing pieces are located along the path. Each dunking station includes a tiltable platform for dumping a playing piece located thereon into a water container. A water reservoir is supported on a tower located adjacent to the base. A water distributor is positioned between the water reservoir and the water containers. A number of intermediate water containers are located between the reservoir and the distributor. A conduit connects the reservoir, the intermediate water containers and the distributor. A valve controls the flow of water from the top reservoir to the conduit. A first marble track is arranged to discharge a marble into the water distributor. A second downwardly inclined track is also supported on the tower. The first marble is released when water fills one of the intermediate water containers. The second marble is releasably actuated by the first marble rolling down the first track. A valve is opened by the second marble rolling down the second track. The distributor is equipped with a number of water discharge outlets, any one of which is closable by the first marble seating in the outlet.

8 Claims, 9 Drawing Figures

Fig. 4.
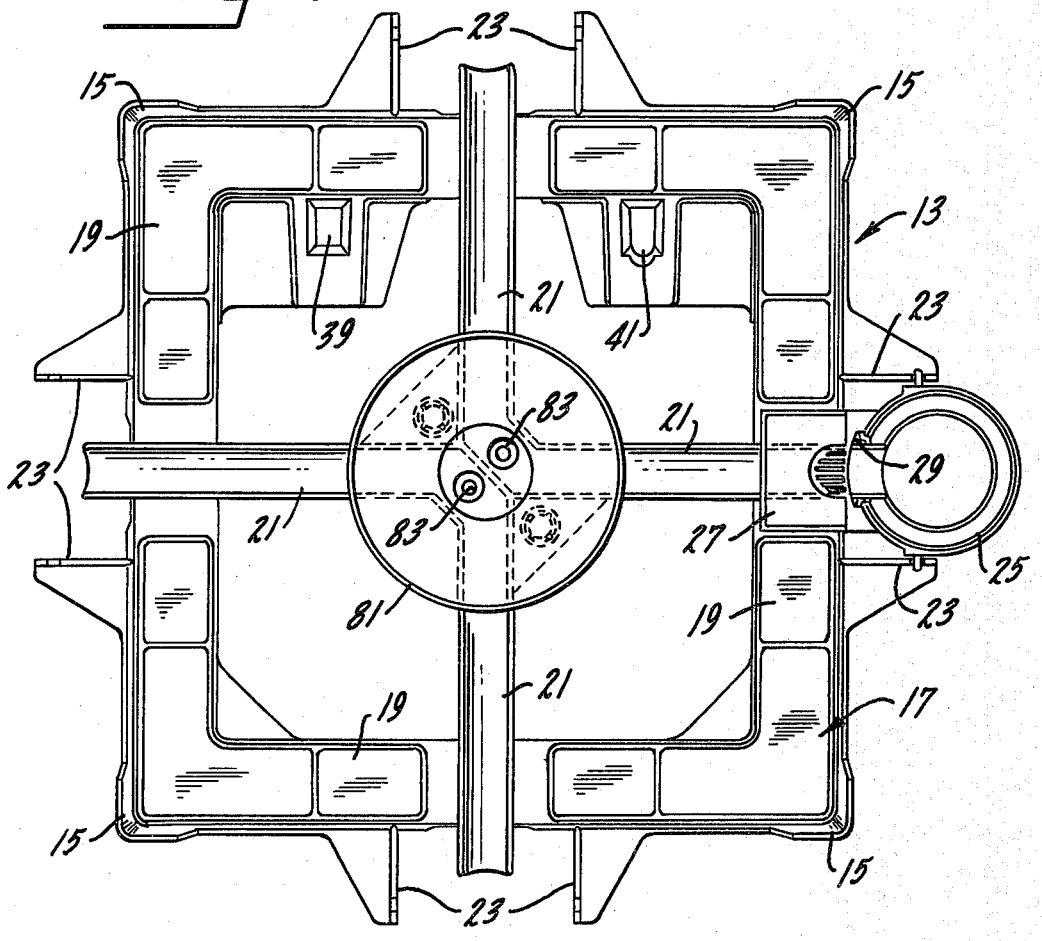
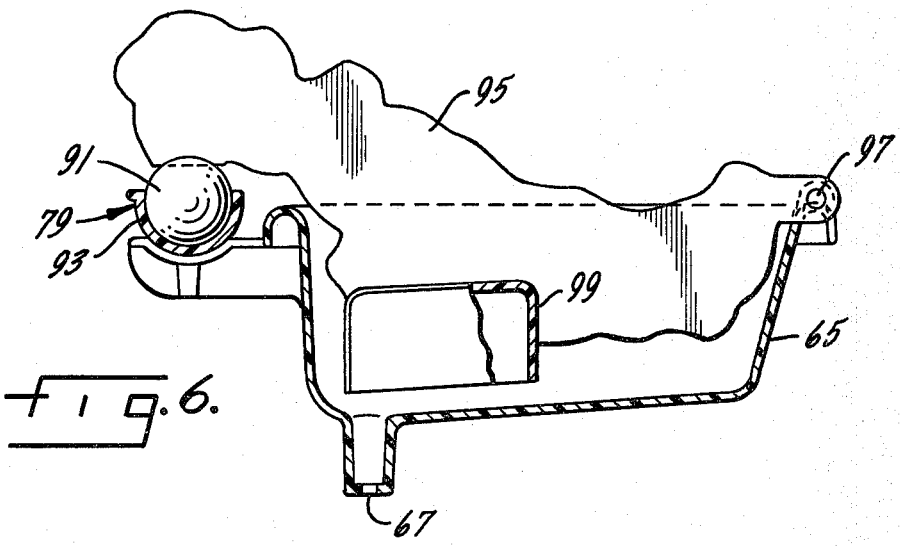
Fig. 6.

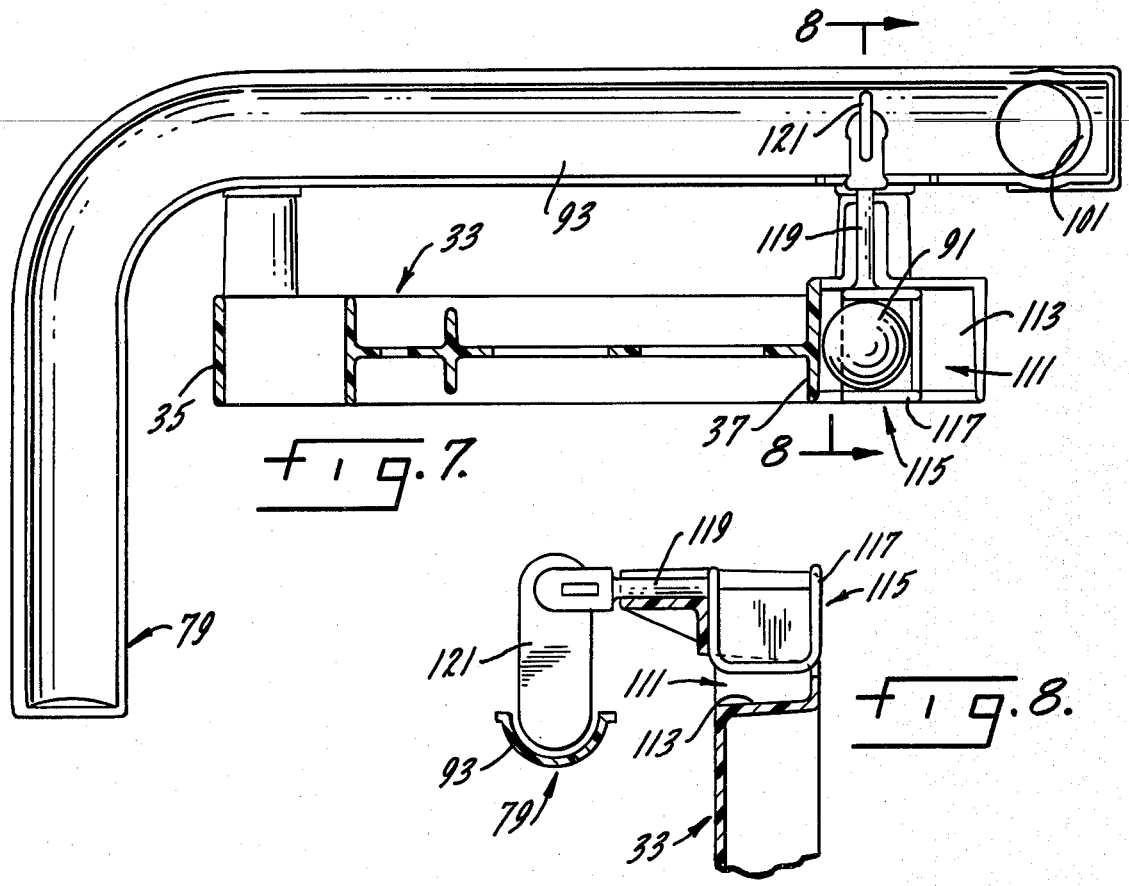
Fig. 7.
Fig. 8.
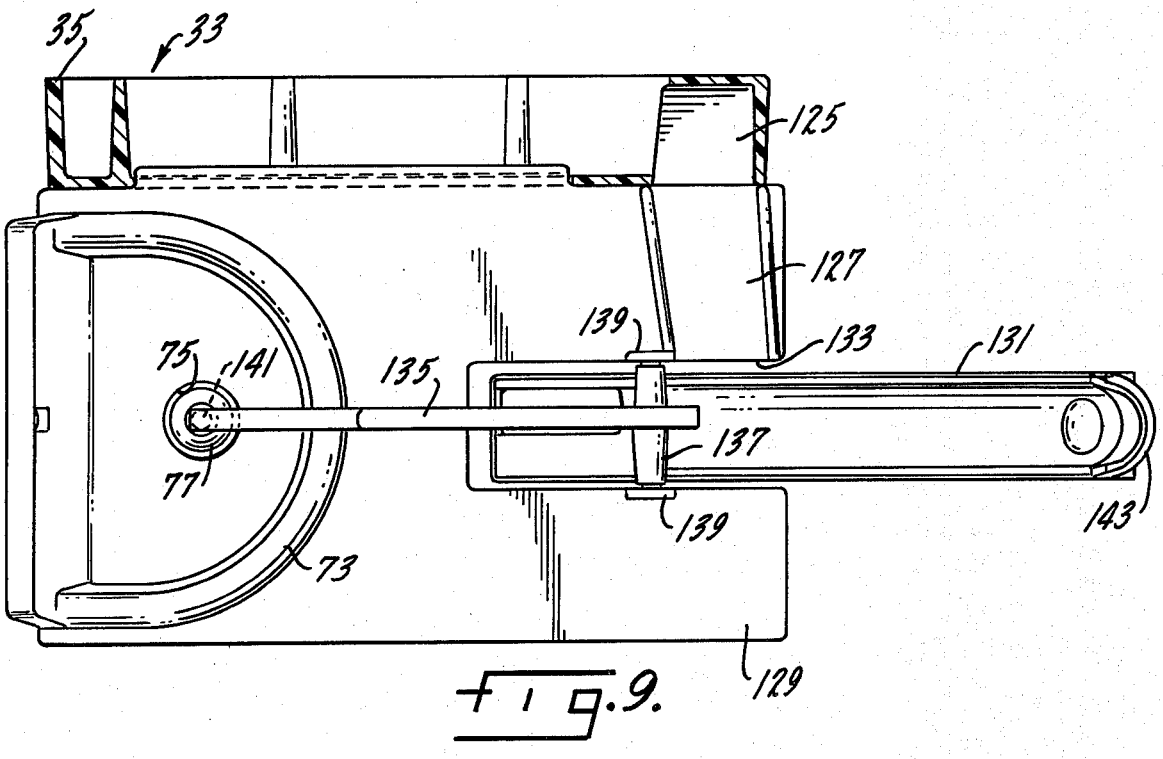
Fig. 9.

BOARD GAME WITH RANDOM WATER DISTRIBUTION FOR DUNKING PLAYING PIECES

BACKGROUND AND SUMMARY OF THE INVENTION

This invention is directed to a board game which amuses the players not only with the excitement of moves controlled by the random rolls of dice but also with the uncertainty caused by the controlled release of water and its random distribution which affects the outcome of the game.

An object of this invention is a game in which playing pieces are removed from play by the accumulation of water in containers which water is released from a reservoir and the accumulation of water in any container is randomly directed.

Another object of this invention is a board game in which the release of water from a reservoir actuates the release of a marble which in turn actuates the release of another marble which allows the flow of water to continue to its ultimate destination.

Another object of this invention is a board game in which the release of marble by water determines the ultimate distribution of the water and the ultimate distribution of the water determines whether or not a particular playing piece is removed from the game.

Another object of this invention is a board game which safely uses a small amount of water in an enticing and interesting manner to amuse the players.

Other objects may be found in the following specification, claims and drawings.

BRIEF DESCRIPTION OF THE DRAWINGS

FIG. 4 is a top plan view of the base of the game of FIG. 1 with parts omitted for clarity of illustration;

FIG. 6 is an enlarged, partial, cross-sectional view of a portion of the game board with some parts broken away;

FIG. 7 is an enlarged top plan view of a portion of the inclined track of the game of FIG. 1 with some parts shown in cross section;

FIG. 8 is a cross-sectional view taken along line 8—8 of FIG. 7 with background omitted for clarity of illustration; and FIG. 9 is an enlarged top plan view of another portion of the game board of FIG. 1 with some parts shown in cross section.

DESCRIPTION OF THE PREFERRED EMBODIMENT

Figures 1, 2, 5:
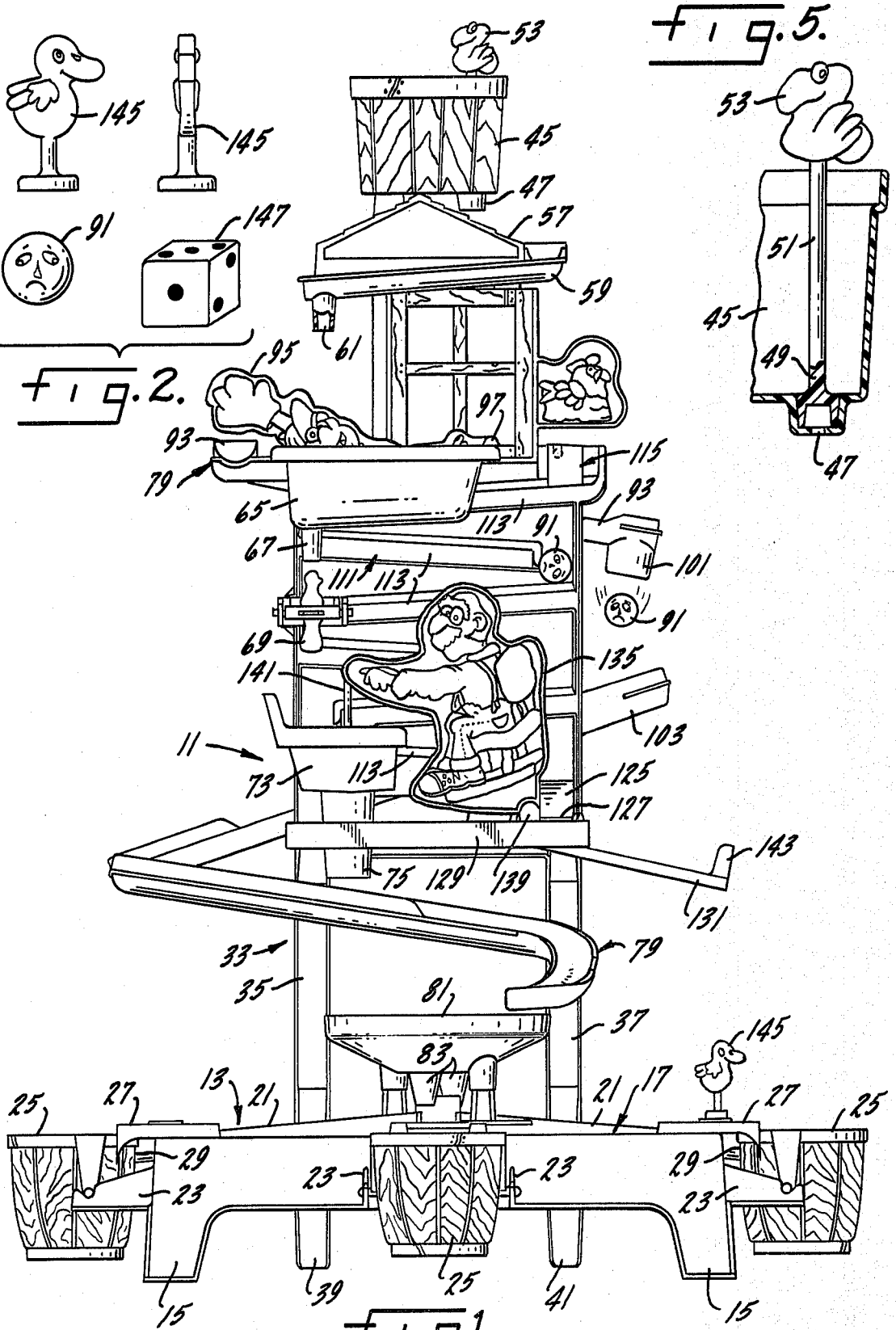
FIG. 1 is a side elevational view of the three dimensional game of this invention.
FIG. 2 is an enlarged view of a playing piece, marble and die used with this game.
FIG. 5 is an enlarged, partial, cross-sectional view of a portion of the game of FIG. 1.
Figure 3:
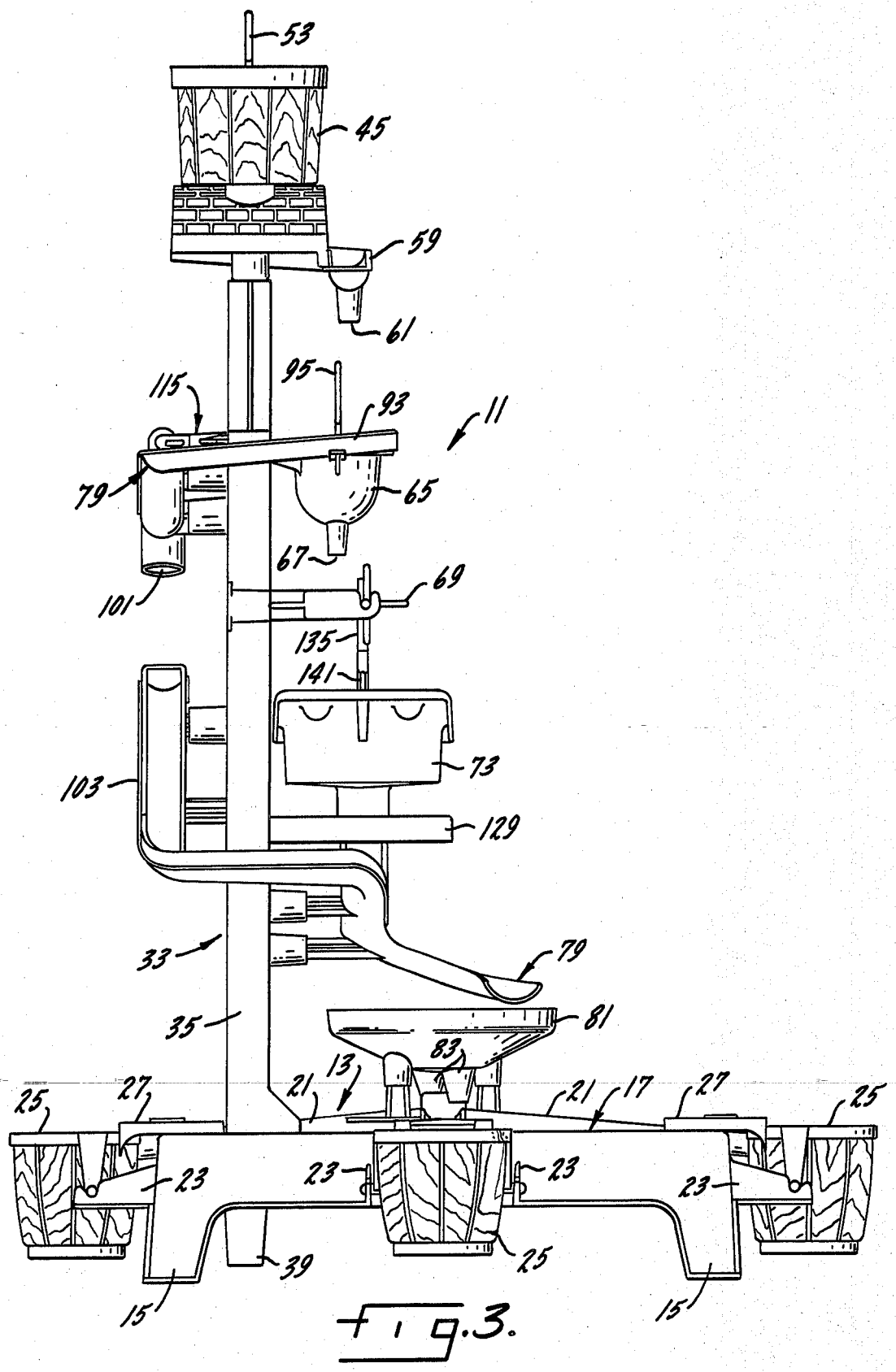
FIG. 3 is a side elevational view of the game of FIG. 1.

A three dimensional board game 11 embodying the novel aspects of this invention is shown in FIGS. 1 through 9 of the drawings. All of the parts of this game preferably are injection molded of a suitable plastic though it should be understood and appreciated that other conventional materials may be utilized in constructing this board game. The game includes a generally hollow square base 13 supported on integrally formed legs 15 located at the four outer corners thereof. A path 17 forms the top of the base and this path is divided into spaces 19 for receiving the playing pieces used in the game. The spaces at each corner of the base may each be identified by a different color. Water distribution flues 21 formed in the shape of a cross extend from the center of the hollow base with each flue extending beyond the outer edge of this side wall of the base. The flues are supported on the base and are molded integrally therewith.

Water container support brackets 23 are mounted on the outer surfaces of the side walls of the base with the brackets arranged in pairs and each pair straddling the discharge end of a flue 21. A water container 25 in the shape of an open top cup is pivotally mounted on each pair of brackets 23 with the mounting being positioned eccentrically to the vertical center line of the container so that when the container is filled with water, it will be unbalanced and will dump the water away from the base 13.

Formed integrally with each container is a platform 27 that extends over the path 17 of the base 13. The platform 27 is designed to support a playing piece for the purpose of dumping it in the container as the container tips over. The portion of the container adjacent to the base is notched at 29 to receive the discharge end of a flue 21 with the notch being sufficiently deep that the outward tipping of the container will not be hindered by engagement with the flue 21.

A tower 33 is mounted on the base 13 at one side along the inner periphery thereof and extends above the base. The tower consists of two columns 35 and 37 each of which fits in a shoe 39 and 41, respectively, molded integrally with the base. The horizontal cross sections of the shoes are of different shapes and the bottoms of the columns are matched to these shapes respectively to key the columns to the shoes to provide proper orientation of the tower relative to the base.

Located at the top of the tower is a water reservoir 45 having a discharge outlet 47 at the lower end thereof (FIG. 5) which is closed by a plunger valve 49 fastened to the lower end of a rod 51. The upper end of the rod 51 extends above the container 45 and a representation 53 of an animal is attached to the rod. The discharge outlet 47 empties onto a sloped roof 57 mounted on the tower, which in turn leads to a gutter 59 having a downspout discharge 61.

An intermediate water container shaped like a bathtub 65 is mounted on the tower and is positioned to receive the water discharged from the downspout 61. The bathtub has a discharge outlet 67 at the lower end thereof which discharge outlet is smaller than the discharge outlet of the downspout 61. A spinner 69 in the shape of a bird is mounted on the tower and aligned with the discharge of the tube drain 67 so that the water flow will cause it to revolve.

A second intermediate water container in the form of a sink 73 is supported on the tower and is positioned immediately below the spinner 69. The sink 73 has an outlet drain opening 75 controlled by a plunger valve 77 which is shown in detail in FIG. 9 of the drawings. The plunger is normally in the closed position preventing discharge of any water from the sink 73. The outlet 75 discharges to a downwardly inclined arcuate track 79 which is also supported on the tower and in turn discharges to a frusto conical shaped water distributor 81 which mounted on the flues 21 of the base 13. The water distributor has a pair of discharge outlets 83 each of which supplies two of the flues 21.

As is shown in enlarged detail in FIG. 6 of the drawings, a marble 91 is held at the top of the upper section 93 of the downwardly inclined track 79 by a first releasable detaining means in the shape of a gloved baseball figure 95. The first releasable detaining means is pivotally connected at 97 to the tub 65 with the detaining means including an inverted cup-like member 99 which functions as a float so that the buildup of water in the tub 65 will cause the retaining means to rise about pivot 97 and release the marble 91 to roll down the upper section 93 of the inclined track 79. The upper section of the track has a discharge outlet opening 101 which drops the marble onto the lower section 103 of the track.

A second inclined marble track 111 is located between the columns 35 and 37 and consists of a number of inclined cascading sections 113. A second releasable marble detaining means 115 is provided. This means, which is shown in enlarged detail in FIGS. 7 and 8 of the drawings, includes a rotary lock 117 which holds a marble 91 at the top of the second inclined track. The rotary locking means 117 has an integral shaft 119 which supports the rotary lock for rotation about a horizontal axis. Connected to the opposite end of the shaft 119 is a paddle 121 which obstructs the upper section 93 of the first inclined marble track 79. A marble 91 rolling down the upper track portion 93 will strike the paddle and rotate the rotary lock 117 to thereby dump a marble 91 on the second inclined track 111 causing it to roll down the inclined cascading sections 113. After the marble 91 moves the paddle 121, it drops through the discharge opening 101 on the upper section 93 of the track and falls to the lower section 103 of the first inclined track 79 and then into the distributor 81.

The second marble 91, after it is released from the rotary lock 117, rolls down the inclined cascading sections 113 of the second inclined track 111 and discharges to a 45° inclined surface 125 at the bottom of the track 111. The inclined surface 125 diverts the marble to a runway 127 located on a platform 129 mounted on the tower 33. The platform 129 is located slightly below the sink 73. The platform is shown in enlarged detail in FIG. 9 of the drawings. A track section 131 for storing the marble extends into a slot 133 formed in the platform 129. The inward end of the track 131 is fastened to a flat irregular piece of material 135 in the shape of a man on a rocking chair which is pivotally connected by a shaft 137 located at its lower end to stubs 139 formed on the platform 129. The opposite end of the man 135 is connected to a rod 141 which connects to the plunger valve 77 controlling the outlet drain of the sink 73. The pivot 137 is located relative to the track section 131 so that when the track does not contain a marble, the weight of the man in the rocking chair 135 will hold the plunger valve 77 in a closed position while the weight of a marble 91 rolling to the outward end of the track section 131 and engaging the stop 143 at the end of the track will tilt the man 135 about the pivotal axis 137 and lifting the plunger 77 from the outlet drain 75 to open it.

Playing pieces in form of ducks 145 and dice 147 are also used in this game and are shown in enlarged detail in FIG. 2 of the drawings. The ducks are supplied in sets of different colors which colors correspond to the colors of the spaces 19 at the corners of the path 17 located on the base 13.

The game of this invention may be played by two to four players. To start a game, the reservoir 45 is filled with water. Each player receives a number of ducks 145, for example, four ducks could be provided for each player. A marble 91 is positioned at the top of track 79 where it is held by the gloved figure 95 and another marble is positioned in the rotary lock 117 at the top of the second inclined track 111.

One of the players may be selected by the roll of dice or otherwise, to begin play. Each space 19 of the path 17 at the corner of the base 13 is marked with a different color which color is the same as that of one of the sets of four ducks. The player selected to start the game places one of his ducks 145 on the corner space 19 which is the same color as his duck. The player then rolls the dice 147 to determine the number of spaces that his duck 145 will be moved along the path 17. Because the dumping platforms 27 form a part of the path 17, the player's duck may land on a dumping platform during its travel along the path 17.

In sequence, the other players start their ducks 145 moving along the path 17 from their respective starting spaces 19 at the corners of the base 13. When a player's duck lands on a corner other than his own starting corner, and if an opponent's duck 145 is located on a dumping platform 27, the player who landed on a corner may release water from the water reservoir 45 by lifting the plunger rod 51. This water flows into the bathtub 65, lifting the glove 95 and releasing the marble 91 at the upper end of the track 79. The water flows out of the tub and spins the spinner 69 and falls into the sink 73. The plunger valve 77 retains this water in the sink while the first marble 91 releases the second marble from the rotary lock 117. The second marble tilts the man on the rocking chair 135 which raises the rod 141 to open the plunger valve 77 allowing the water out of the sink 73. The water then flows into the distributor 81 in which the first marble 91 has already entered and blocked one of the two outlets 83. Since none of the players know which of the two outlets 83 will be blocked by the marble, no one will know which of the cups 25 will be filled with water when the water is released from the reservoir 45. A duck 145 on one of the dumping platforms 27 may or may not be dunked by the release of water. If the duck 145 is dunked into the water in a cup 25, it is removed from the game and is lost to its player. The two cups 25 which receive the water are then removed from their support brackets 23 and the water is returned to the reservoir 45 for the next play.

The player who manages to successfully traverse the path 17 with the most ducks is the winner. In the game, each player may play with one or more ducks on the path 17 at any particular time.

I claim:

1. A game including:

a base having a path defined by a plurality of spaces on which playing pieces can be moved from a starting point to a finish point as a result of the selection of a random number of spaces for each move of each playing piece, a plurality of dunking stations for the playing pieces located along the path, each of the dunking stations including a tiltable platform for dumping a playing piece located thereon into a water container, each water container being mounted on the base, each tiltable platform functioning as a space of the path, a tower located adjacent the base, a water reservoir supported on the tower near the top thereof, a water distributor positioned between the water reservoir and the water containers mounted on the base, a plurality of intermediate water containers located between the top reservoir and the distributor, a conduit connecting the top reservoir, the intermediate water containers and the distributor, a plurality of valves controlling the flow of water along the conduit, a first of the valves controlling the flow of water from the top reservoir to the conduit, a first downwardly inclined marble track supported on the tower and arranged to discharge a marble into the water distributor, a first releasable detaining means for holding a first marble near the top of the first track and for selectively releasing the first marble to allow it to roll down the first track, a second downwardly inclined marble track also supported on the tower, a second releasable detaining means for holding a second marble near the top of the second track and for selectively releasing the second marble to allow it to roll down the second track, the first releasable detaining means for holding the first marble being releasably actuated by water filling one of the intermediate water containers, the second releasable detaining means for holding the second marble being releasably actuated by the first marble rolling down the first track, a second of the valves controlling the flow of water through the conduit controls the flow of water out of another of the intermediate containers, and means are provided for opening the second valve by the second marble rolling down the second track, the distributor being equipped with a plurality of water discharge outlets each of which is closable by the first marble seating in the outlet, a plurality of flues located beneath the distributor with each flue aligned with a distributor discharge outlet and a water container on the base.

2. The game of claim 1 in which each container is part of one of the tiltable platforms and each container is supported on the base to tilt with its platform when it is filled with water.

3. The game of claim 1 in which the first of the valves is manually operated.

4. The game of claim 1 in which the first releasable detaining means is releasably actuated by a float which lifts a marble stop when the water fills one of the intermediate water containers.

5. The game of claim 1 in which the second releasable detaining means includes a rotary lock for detaining the second marble and an actuating arm for rotating the rotary lock to a marble discharge position with the actuating arm positioned to be engaged and actuated by the first marble rolling down the first marble track.

6. The game of claim 1 in which the means for opening the second valve by the second marble rolling down the second track includes a plunger valve located in the another of the intermediate containers, a pivotally mounted track section at the lower end of the second track, and a connection between the track section and the plunger valve arranged to lift the plunger valve when the second marble moves the track section down about the pivot.

7. The game of claim 1 in which the water distributor includes a pair of water discharge outlets, each water discharge outlet discharges to a pair of flues and means are provided to divide the water from each discharge outlet among the pair of flues.

8. The game of claim 1 in which the base is a hollow rectangle, the spaces form a path around the periphery of the hollow rectangle, the water containers are mounted on the base along the outside of the hollow rectangle with each container located at the center of its side, the tower is located inside the hollow rectangle, and each water container on the base is eccentrically supported to tilt its platform away from the base when filled with water.

* * * * *